US007218888B2

(12) United States Patent
Osawa

(10) Patent No.: US 7,218,888 B2
(45) Date of Patent: May 15, 2007

(54) IMAGE FORMATION APPARATUS

(75) Inventor: Tatsuro Osawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 261 days.

(21) Appl. No.: 11/066,612

(22) Filed: Feb. 24, 2005

(65) Prior Publication Data

US 2005/0196205 A1 Sep. 8, 2005

(30) Foreign Application Priority Data

Feb. 26, 2004 (JP) ..... P2004-051358

(51) Int. Cl.
*G03G 21/00* (2006.01)

(52) U.S. Cl. ..... 399/358; 399/343; 399/345

(58) Field of Classification Search ..... 399/107, 399/110, 123, 343, 345, 350, 351, 358; 15/256.5, 15/256.51, 256.52
See application file for complete search history.

(56) References Cited

U.S. PATENT DOCUMENTS 5,390,010 A * 2/1995 Yamahata et al. ..... 399/308
6,760,554 B2 * 7/2004 Fina et al. ..... 399/102
6,925,282 B2 * 8/2005 Drawe et al. ..... 399/349

FOREIGN PATENT DOCUMENTS

| | | |
|---|---|---|
| JP | 01-277275 | 11/1989 |
| JP | 02-100081 | 4/1990 |
| JP | 05-004174 | 1/1993 |
| JP | 2003-295722 | 10/2003 |

* cited by examiner

*Primary Examiner*—Hoan Tran
(74) *Attorney, Agent, or Firm*—Hogan & Hartson LLP

(57) ABSTRACT

An image formation apparatus includes a cleaning device capable of coming into and out of contact with the front surface of a toner image carrier which rotates with toner images adhering on its front surface, and for removing toners adherent on the front surface of the toner image carrier during the contact. A toner reception portion is disposed on a downstream side than the contact position between the cleaning device and the toner image carrier as viewed in the moving direction of the front surface of the toner image carrier, and it is partitioned into a plurality of chambers by a partition plate which extends in a direction substantially orthogonal to the moving direction of the front surface of the toner image carrier.

7 Claims, 5 Drawing Sheets

IMAGE FORMATION APPARATUS

BACKGROUND OF THE INVENTION

1. Field of the Invention

The present invention relates to an image formation apparatus, such as printer, facsimile or copying machine, which forms an image by employing electrophotography. More particularly, it relates to improvements in a cleaning device which is capable of coming into and out of contact with the front surface of a toner image carrier, and which removes remaining toners adherent on the front surface of the toner image carrier during the contact.

2. Description of the Related Art

In general, an image formation apparatus employing electrophotography includes a photosensitive body which has a photosensitive layer at its outer peripheral surface, a charging device for uniformly charging the outer peripheral surface of the photosensitive body, an exposure device for selectively exposing to light the outer peripheral surface having been uniformly charged by the charging device, thereby to form an electrostatic latent image, a developing device for giving toners being developing agents, to the electrostatic latent image formed by the exposure device, thereby to turn the latent image into a visible image (toner images), a transfer device for transferring the toner images developed by the developing device, onto a sheet of paper or the like recording medium being a subject for transfer, and a cleaning device for removing the toners remaining on the front surface of the photosensitive body after the transfer.

Known as the transfer device is one having a toner image carrier (for example, intermediate transfer medium) onto which the toner images formed on the photosensitive body are transferred (primarily transferred), which carries the transferred toner images thereon, and which transfers (secondarily transfers) the toner images onto the sheet of paper or the like recording medium being the subject for transfer. The intermediate transfer medium (toner image carrier) is also furnished with a cleaning device.

Usually, the cleaning device of the photosensitive body need not have a construction in which it is brought into and out of contact with the photosensitive body. Since, however, the intermediate transfer medium (toner image carrier) collectively transfers the toner images in, for example, a plurality of colors as have been superimposed, onto the subject for transfer (the sheet of paper or the like recording medium), the cleaning device needs to be brought out of contact with the intermediate transfer medium during the superimposition operation of the toner images, and to be brought into contact after the collective transfer.

In such an image formation apparatus, when the cleaning device has come out of contact with the toner image carrier, the toners adhering to the cleaning device scatter and float within the image formation apparatus, thereby to incur various problems that the toners adhere to the intermediate transfer medium or the photosensitive body to degrade a picture quality, that the toners pollute the interior of the apparatus, and so forth.

In this regard, there has heretofore been proposed an image formation apparatus which is furnished with a shutoff mechanism for shutting off a toner outflow port when the cleaning device has come out of contact with the front surface of the toner image carrier (refer to, for example, JP-A-2003-295722).

The related art technique has had the problem that, even when the shutoff mechanism is quickly actuated, the toners scatter yet. Also, it has had the problem that, since the shutoff mechanism needs to be disposed, the structure of the apparatus becomes complicated.

SUMMARY OF THE INVENTION

An object of the present invention is to provide an image formation apparatus in which toners can be restrained from scattering into the whole apparatus, by a simple construction.

In order to accomplish the object, the image formation apparatus of the present invention consists in an image formation apparatus including a toner image carrier which rotates with toner images adhering on its front surface, and a cleaning device capable of coming into and out of contact with the front surface of the toner image carrier, and for removing toners adherent on the front surface of the toner image carrier during the contact, characterized in:

that a toner reception portion is disposed on a downstream side than a contact position between the cleaning device and the toner image carrier as viewed in a moving direction of the front surface of the toner image carrier at the contact position, and that the toner reception portion is partitioned into a plurality of chambers.

With such a construction, most of the toners which scatter from the cleaning device when the cleaning device has come out of contact with the toner image carrier can be captured by the toner reception portion, and the toners can be restrained from scattering into the whole apparatus.

The toner image carrier is rotating, so that wind extending in the moving direction of the front surface of the toner image carrier occurs near the front surface. Since, however, the toner reception portion is disposed on the downstream side in the moving direction of the front surface of the toner image carrier, the toners which come floating in the wind can be captured effectively.

Moreover, the toner reception portion is partitioned into the plurality of chambers, which function as toner capture chambers, respectively, so that the toners which come floating in the wind can be captured efficiently.

Further, owing to the partition of the toner reception portion into the plurality of chambers, the area of those inwall surfaces of the chambers of the toner reception portion onto which the toners can adhere becomes large, so that the toners can be captured more efficiently.

Still further, even when the image formation apparatus is shaken, or the toner reception portion is shaken due to the exchange operation of this toner reception portion, or the like, the toners in the toner reception portion are less liable to move or to spill, owing to the partition of the toner reception portion into the plurality of chambers.

Desirably, the apparatus is so constructed that the toner reception portion is partitioned by a partition plate which extends in a direction substantially orthogonal to the moving direction of the front surface of the toner image carrier with respect to the moving direction.

With such a construction, the toners which come floating in the wind can be captured efficiently in stages by the plurality of chambers (plurality of toner capture chambers) which are partitioned by the partition plate extending in the direction substantially orthogonal to the moving direction of the image carrier surface (accordingly, the moving direction of the wind). Besides, the toners are liable to impinge against the partition wall extending in the direction substantially orthogonal to the direction of the wind, so that the toners can be captured more efficiently.

Desirably, the apparatus is so constructed that an upper end of a rising wall which is located on the most downstream side with respect to the moving direction of the front surface of the toner image carrier, in the toner reception portion, is adjacent to the front surface of the toner image carrier.

With such a construction, the toners which are about to pass through the gap between the front surface of the toner image carrier and the toner reception portion are liable to hindered by the rising wall located on the most downstream side, and the toners can be captured more reliably.

Desirably, the apparatus is so constructed that a distance between the front surface of the toner image supporter and the upper end of the partition plate, in the toner reception portion, is larger as compared with a distance between the front surface of the toner image supporter and the upper end of the rising wall located on the most downstream side with respect to the moving direction of the front surface of the toner image carrier.

With such a construction, the toners can be captured substantially equally into the plurality of chambers partitioned by the partition plate, and the capturable quantity of the toners can be consequently enhanced. More specifically, since the toners are carried floating in the wind, they are more liable to drop on the upstream side of the wind. In this regard, with the construction in which the distance between the front surface of the toner image carrier and the upper end of the partition plate is larger as compared with the distance between the front surface of the toner image carrier and the upper end of the rising wall located on the most downstream side with respect to the moving direction of the front surface of the toner image carrier (accordingly, the direction of the wind), the toners which are carried by the wind are liable to enter the chamber (toner capture chamber) on the downstream side through the gap between the front surface of the toner image carrier and the upper end of the partition wall. It is accordingly permitted to capture the toners substantially equally into the plurality of chambers partitioned by the partition plate.

Desirably, the apparatus is so constructed that at least two such partition plates are disposed, and that the upper ends of the partition plates are nearer to the front surface of the toner image carrier on the downstream side in the moving direction of the front surface of the toner image carrier.

With such a construction, the toners can be captured efficiently by at least three toner-capture chambers, and they can be captured substantially equally into the plurality of chambers, for the reasons stated above.

The apparatus is so constructed that the toner image carrier is constructed of a belt, and that, in a case where a bent portion which changes a traveling direction of the belt is provided on the downstream side in the moving direction of the front surface of the toner image carrier, than the contact position between the cleaning device and the toner image carrier, the toner reception portion extends to under the bent portion.

When the bent portion is provided, the toners which slightly remain on the belt surface (in spite of the provision of the cleaning device, some toners remain without being removed) might drop from the bent portion due to slight vibrations in this bent portion, but such toners can also be captured by extending the toner reception portion to under the bent portion.

Desirably, the toner reception portion is constructed integrally with a cleaning case on which the cleaning device is mounted.

With such a construction, the toner reception portion can be disposed at a high positional precision relative to the contact position between the cleaning device and the toner image carrier, and simultaneously, any toner reception portion need not be disposed separately from the cleaning case.

Moreover, assuming that the cleaning case and the toner reception portion be made separate members, the toners might leak out through the gap between both the members, but such is not apprehended owing to the construction of the toner reception portion integral with the cleaning case.

DETAILED DESCRIPTION OF THE PREFERRED EMBODIMENTS

Now, embodiments of the present invention will be described with reference to the drawings.

Figure 1:
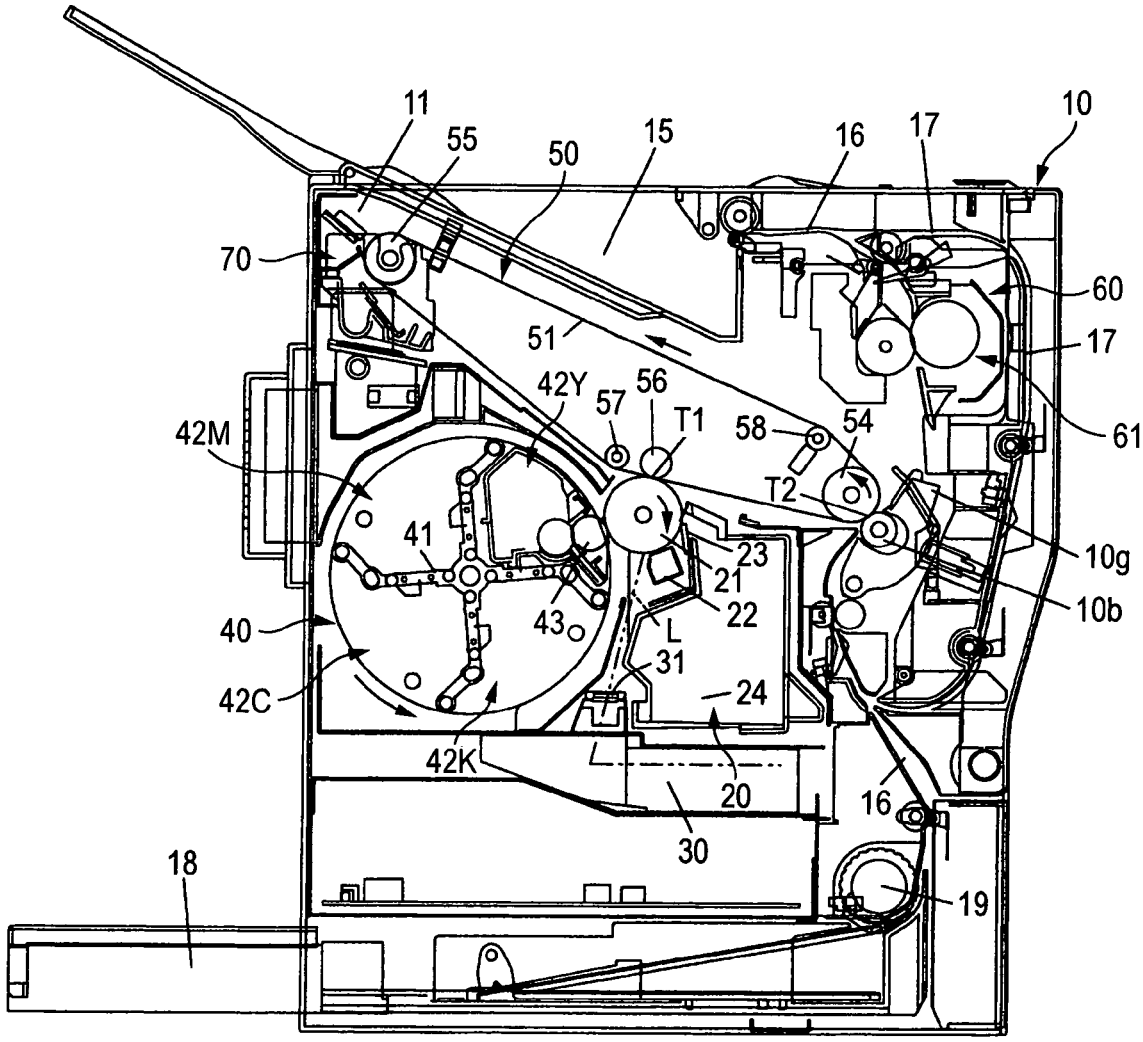
FIG. 1 is a schematic sectional view showing the internal structure of one embodiment of an image formation apparatus according to the present invention.

FIG. 1 is a schematic sectional view showing the internal structure of one embodiment of an image formation apparatus according to the invention.

The image formation apparatus is a color image formation apparatus which can form full-color images on both the sides of a sheet of paper (recording medium) of A3-size, and which includes a case 10, an image carrier unit 20 accommodated in the case 10, an exposure unit 30 being an exposure device, a developer 40 being a developing device, an intermediate transfer medium unit 50, and a fixing unit (fixer) 60 being a fixing device.

The case 10 is provided with the unshown frame of the apparatus proper, and the individual units are attached to the frame.

The image carrier unit 20 includes a photosensitive body 21 which has a photosensitive layer at its outer peripheral surface, and a corona charger (scorotron charger) 22 which is a charging device for uniformly charging the outer peripheral surface of the photosensitive body 21. That outer peripheral surface of the photosensitive body 21 which has been uniformly charged by the corona charger 22 is selectively exposed to light by a laser beam L from the exposure unit 30, thereby to form an electrostatic latent image. The electrostatic latent image is given toners being developing agents, by the developer 40, thereby to be turned into visible images (toner images). The toner images are primarily transferred onto the intermediate transfer belt 51 of the intermediate transfer medium unit 50 in a primary transfer portion T1. Further, the toner images are secondarily transferred onto the sheet of paper being a subject for transfer, in a secondary transfer portion T2.

The image carrier unit 20 is provided with a cleaning blade 23 which removes the toners remaining on the front surface of the photosensitive unit 21 after the primary transfer, and a waste toner accommodation portion 24 being a waste toner reservoir, which accommodates therein the waste toners removed by the cleaning blade 23.

Provided in the case 10 are a conveyance path 16 along which the sheet of paper formed with the image on one side thereof by the secondary transfer portion T2 is conveyed toward a sheet-of-paper ejection portion (paper ejection tray portion) 15 located on the upper side of the case 10, and a return path 17 along which the sheet of paper conveyed toward the sheet-of-paper ejection portion 15 by the conveyance path 16 is switched back and returned toward the secondary transfer portion T2 so as to form an image also on the other side thereof.

Disposed at the lower parts of the case 10 are a paper feed tray 18 which stacks and holds a plurality of sheets of paper, and a paper feed roller 19 which feeds the sheets of paper toward the secondary transfer portion T2 one by one.

The developer 40 is a rotary developer, in which a plurality of developer cartridges each accommodating the toner therein are detachably attached to a rotary member body 41. In this embodiment, a developer cartridge 42Y for yellow, a developer cartridge 42M for magenta, a developer cartridge 42C for cyan and a developer cartridge 42K for black are disposed (in the figure, only the developer cartridge 42Y for yellow is directly depicted). The rotary member body 41 rotates at pitches of 90 degrees in the direction of an arrow, whereby a developing roller 43 is selectively brought into contact with the photosensitive body 21, and the front surface of the photosensitive body 21 can be selectively developed.

The exposure unit 30 projects the laser beam L toward the photosensitive body 21 through an exposure window 31 which is constructed of plate glass or the like.

The intermediate transfer medium unit 50 includes a unit frame which is not shown, a driving roller 54, a driven roller 55, a primary transfer roller 56, a guide roller 57 for stabilizing the state of the belt 51 in the primary transfer portion T1, and a tension roller 58 which are rotatably supported by the unit frame, and the intermediate transfer belt 51 which is extended over the rollers. Herein, the belt 51 is circulatively driven in the direction of an indicated arrow. The primary transfer portion T1 is formed between the photosensitive body 21 and the primary transfer roller 56, while the secondary transfer portion T2 is formed at the pressure contact part between the driving roller 54 and a secondary transfer roller 10*b* which is disposed on the body side.

The secondary transfer roller 10*b* is capable of coming into and out of contact with the driving roller 54 (accordingly, with the intermediate transfer belt 51), and the secondary transfer portion T2 is formed in a case where the roller 10*b* has come into contact with the roller 54.

In the case of obtaining the color image, accordingly, the color image is formed in such a way that the toner images in the plurality of colors are superimposed on the intermediate transfer belt 51 in a state where the secondary transfer roller 10*b* is out of contact with the intermediate transfer belt 51, and the color image (toner images) is thereafter transferred (secondarily transferred) from on the intermediate transfer belt 51 onto the sheet of paper in such a way that the secondary transfer roller 10*b* comes into contact with the intermediate transfer belt 51, and that the sheet of paper is fed to the contact part (secondary transfer portion T2).

The sheet of paper onto which the toner images have been transferred has the toner images melted and fixed by passing through the gap between the pair of heating rollers 61 of the fixing unit 60, and it is sent toward the paper ejection tray portion 15.

Numeral 70 designates a cleaning device, which is a device for removing the toners that remain on the front surface of the intermediate transfer belt 51 being the toner image carrier, after the secondary transfer.

Figure 2:
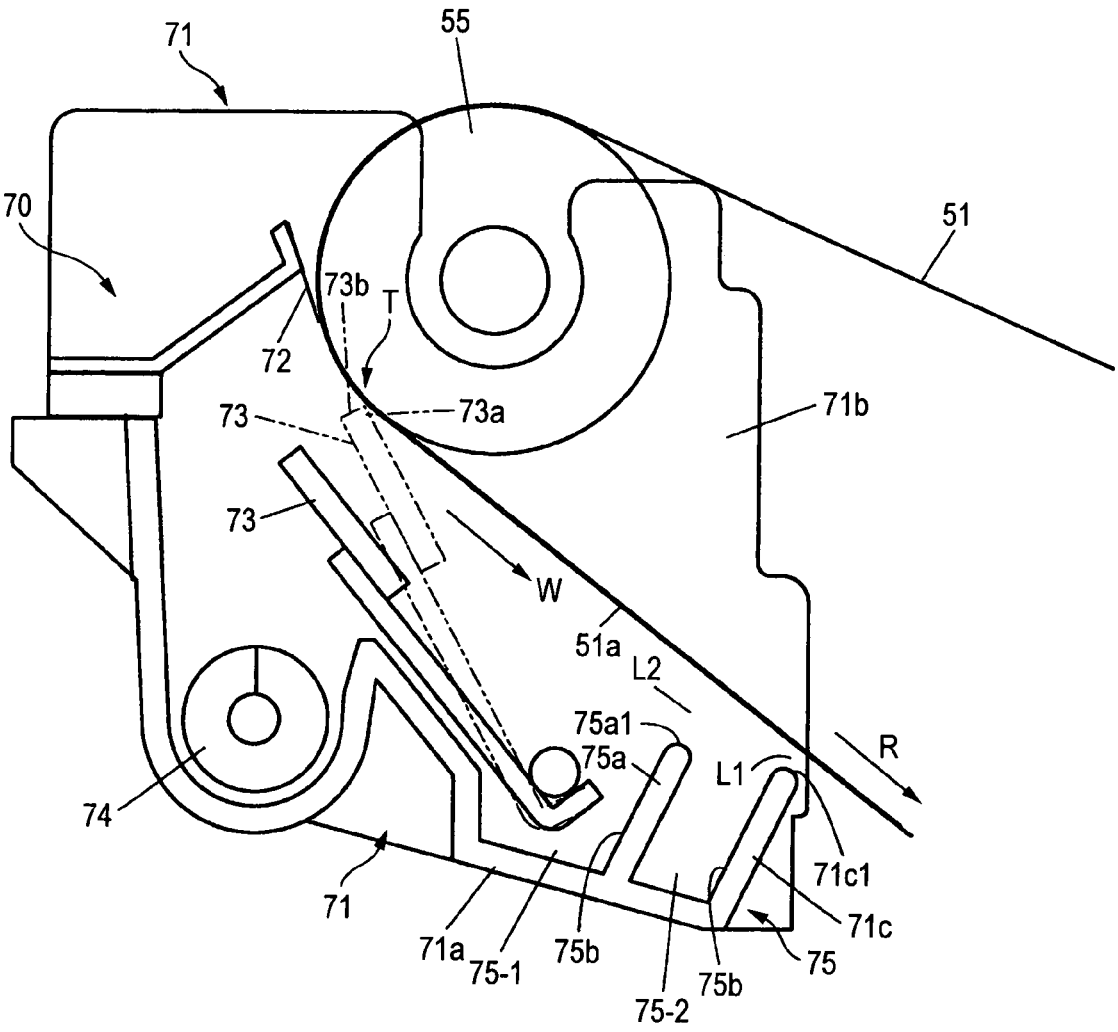
FIG. 2 is a partial enlarged view of FIG. 1.

As shown in FIG. 2, the cleaning device 70 has a cleaning case 71, a seal 72, and a cleaning blade 73 being a cleaning device.

The cleaning device 70 has an in-contact/out-of-contact mechanism not shown, which brings the cleaning blade 73 out of contact with the front surface of the intermediate transfer belt 51 as indicated by solid lines in FIG. 2, in the case where the superimposition of the toner images is performed on the intermediate transfer belt 51 being the intermediate transfer medium, and which brings the cleaning blade 73 into contact with the front surface of the intermediate transfer medium 51 as indicated by phantom lines, after the toner images on the intermediate transfer belt 51 have been secondarily transferred onto the sheet of paper or the like.

The cleaning blade 73 brings its corner part 73*a* into contact with the front surface of the intermediate transfer belt 51 in a direction counter to the moving direction R of this belt, thereby to remove the remaining toners on the front surface of the intermediate transfer belt 51 so as to scrape them off.

After the toners scraped off have stayed on the upper surface 73*b* of the cleaning blade 73, they drop into the case 71, and they are conveyed toward a waste toner box not shown, by a screw 74 which is disposed within the case 71.

In the image formation apparatus as described above, the intermediate transfer belt 51 is rotating, so that wind W which extends in the moving direction R of the front surface 51*a* of the intermediate transfer belt 51 occurs near the front surface 51*a*.

Figure 5A:
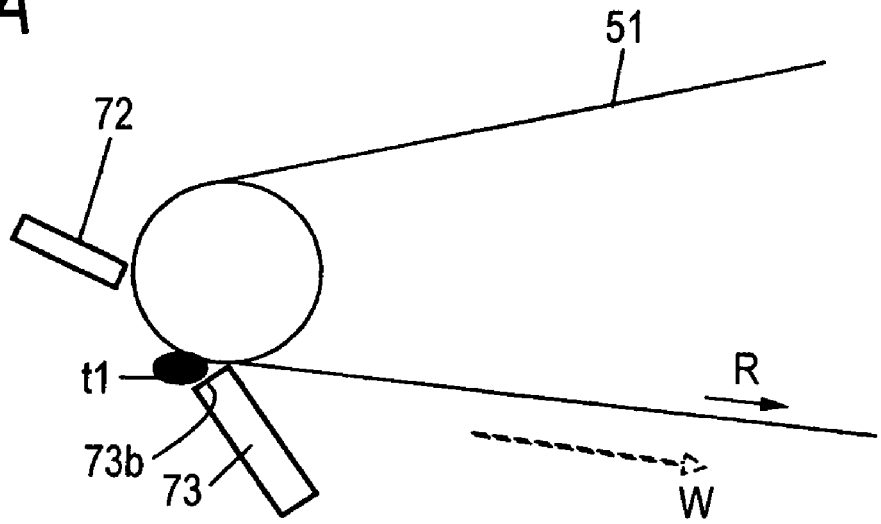
FIGS. 5A and 5B are views for explaining a problem.
Figure 5B:
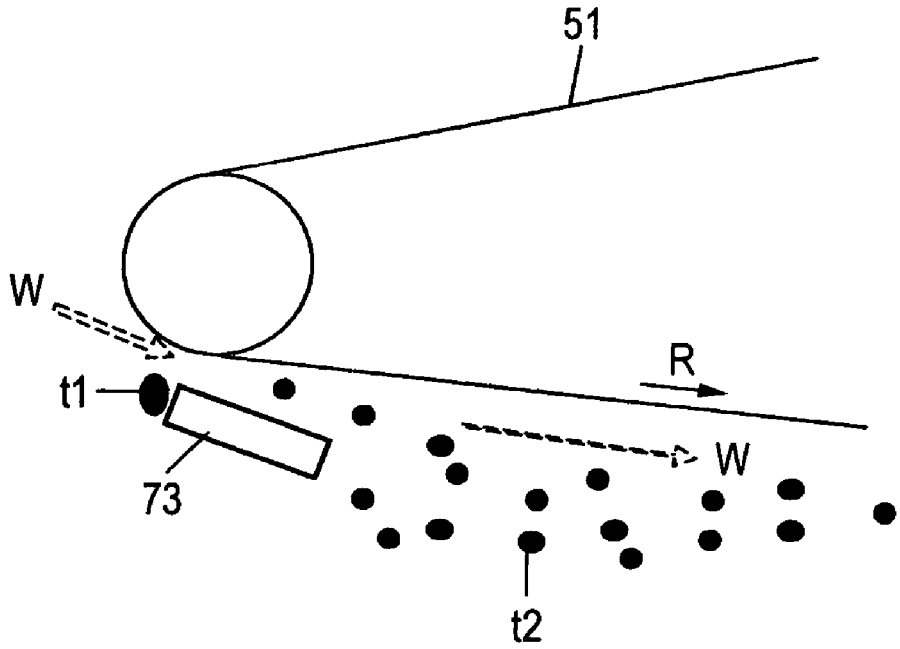

Therefore, the toners t1 which have stayed on the upper surface 73*b* of the cleaning blade 73 during the contact of this cleaning blade 73 with the front surface 51*a* of the intermediate transfer belt 51 as shown in FIG. 5A are blown away by the wind W (blown toners are indicated by sign t2) when the cleaning blade 73 comes out of contact with the intermediate transfer belt 51, as shown in FIG. 5B. When the blown toners are let stand, they scatter in the image formation apparatus and incur various problems as stated before.

In this embodiment, therefore, as shown in FIG. 2, a toner reception portion 75 is disposed on a downstream side than the contact position T between the cleaning blade 73 and the intermediate transfer belt 51 as viewed in the moving direction of the front surface 51*a* of the intermediate transfer belt 51 at the contact position T, and the toner reception portion 75 is partitioned into a plurality of chambers 75-1 and 75-2.

The toner reception portion 75 is constructed integrally with the cleaning case 71 on which the cleaning blade 73 is mounted.

More specifically, the toner reception portion 75 is formed of the bottom plate 71*a* of the case 71, side plates 71*b* and 71*b* on both the right and left sides of the bottom plate (only the side plate on the deep side is shown in FIG. 2), a rising wall 71*c* which is disposed on the most downstream side with respect to the moving direction R of the front surface of the intermediate transfer belt 51, and a partition plate 75*a*. Incidentally, these portions are unitarily formed in the shape of a saucer (toner receptacle).

The partition plate 75*a* extends in a direction substantially orthogonal to the moving direction R of the front surface 51*a* of the intermediate transfer belt 51 (in a direction substantially orthogonal to the sheet of the drawing of FIG. 2).

The upper end 71*c*1 of the rising wall 71*c* is adjacent to the front surface 51*a* of the intermediate transfer belt 51, and the distance L2 between the upper end 75*a*1 of the partition plate 75*a* and the front surface 51*a* of the intermediate transfer belt 51 is larger as compared with the distance L1 between the upper end 71*c*1 of the rising wall 71*c* and the front surface 51*a* of the intermediate transfer belt 51.

According to the image formation apparatus as thus far described, functional effects as stated below are attained.

(a) The image formation apparatus includes the toner image carrier 51 which rotates with the toner images adhering on its front surface 51*a*, and the cleaning device 73 capable of coming into and out of contact with the front surface 51*a* of the toner image carrier 51, and for removing the toners adherent on the front surface 51*a* of the toner image carrier 51 during the contact. The toner reception portion 75 is disposed on the downstream side than the contact position T between the cleaning device 73 and the toner image carrier 51 as viewed in the moving direction R of the front surface 51*a* of the toner image carrier 51 at the contact position T, and it is partitioned into the plurality of chambers 75-1 and 75-2. Therefore, most of the toners which scatter from the cleaning device 73 (its upper surface 73*b* in this case) when the cleaning device 73 has come out of contact with the toner image carrier 51 can be captured by the toner reception portion 75, and the toners can be restrained from scattering into the whole apparatus.

More specifically, since the toner image carrier 51 is rotating, the wind W extending in the moving direction R of the front surface 51*a* of the toner image carrier 51 occurs near this front surface 51*a*. Since, however, the toner reception portion 75 is disposed on the downstream side in the moving direction R of the front surface 51*a* of the toner image carrier 51, the toners which come floating in the wind W can be captured effectively.

Moreover, the toner reception portion 75 is partitioned into the plurality of chambers 75-1 and 75-2, and these chambers 75-1 and 75-2 function as toner capture chambers, respectively, so that the toners which come floating in the wind W can be captured efficiently.

Further, owing to the partition of the toner reception portion 75 into the plurality of chambers, the areas of those inwall surfaces 75*b* of the chambers of the toner reception portion 75 on which the toners can adhere become large, so that the toners can be captured more efficiently.

Still further, even when the image formation apparatus is shaken, or the toner reception portion 75 is shaken due to the exchange operation of this toner reception portion 75 (the cleaning device 70 in this case), or the like, the toners in the toner reception portion 75 are less liable to move or to spill, owing to the partition of the toner reception portion 75 into the plurality of chambers.

(b) The toner reception portion 75 is partitioned by the partition plate 75*a* which extends in the direction substantially orthogonal to the moving direction R of the front surface 51*a* of the toner image carrier, so that the toners which come floating in the wind W can be captured efficiently in stages by the plurality of chambers (plurality of toner capture chambers) 75-1 and 75-2 which are partitioned by the partition plate 75*a* extending in the direction substantially orthogonal to the moving direction R of the image carrier surface 51*a* (accordingly, the moving direction of the wind). Besides, the toners are liable to impinge against the partition wall 75*a* extending in the direction substantially orthogonal to the direction of the wind W, so that the toners can be captured more efficiently.

(c) The upper end 71*c*1 of the rising wall 71*c* which is located on the most downstream side in the toner reception portion 75 with respect to the moving direction R of the front surface 51*a* of the toner image carrier is adjacent to this front surface 51*a* of the toner image carrier, so that the toners which are about to pass through the gap between the front surface 51*a* of the toner image carrier and the toner reception portion 75 are liable to hindered by the rising wall 71*c* located on the most downstream side, and the toners can be captured more reliably.

(d) The distance L2 between the front surface 51*a* of the toner image carrier and the upper end 75*a*1 of the partition plate 75*a* is larger as compared with the distance L1 between the front surface 51*a* of the toner image carrier and the upper end 71*c*1 of the rising wall 71*c* located on the most downstream side in the toner reception portion 75 with respect to the moving direction R of the front surface 51*a* of the toner image carrier, so that the toners can be captured substantially equally into the plurality of chambers 75-1 and 75-2 partitioned by the partition plate 75*a*, and the capturable quantity of the toners can be consequently enhanced. More specifically, since the toners are carried floating in the wind W, they are more liable to drop on the upstream side of the wind W (the side of the capture chamber 75-1). In this regard, with the construction in which the distance L2 between the front surface 51*a* of the toner image carrier and the upper end 75*a*1 of the partition plate 75*a* is larger as compared with the distance L1 between the front surface 51*a* of the toner image carrier and the upper end 71*c*1 of the rising wall 71*c* located on the most downstream side with respect to the moving direction R of the front surface 51*a* of the toner image carrier (accordingly, the direction of the wind), the toners which are carried by the wind W are liable to enter also the chamber (toner capture chamber) 75-2 on the downstream side through the gap (the larger gap L2) between the front surface 51*a* of the toner image carrier and the upper end 75*a*1 of the partition wall 75*a*. It is accordingly permitted to capture the toners substantially equally into the plurality of chambers 75-1 and 75-2 partitioned by the partition plate 75*a*.

(e) The toner reception portion 75 is constructed integrally with the cleaning case 71 on which the cleaning device 73 is mounted, so that the toner reception portion 75 can be disposed at a high positional precision relative to the contact position T between the cleaning device 73 and the toner image carrier 51, and simultaneously, any toner reception portion need not be disposed separately from the cleaning case 71.

Moreover, assuming that the cleaning case 71 and the toner reception portion 75 be made separate members, the toners might leak out through the gap between both the members, but such is not apprehended owing to the construction of the toner reception portion 75 integral with the cleaning case 71.

Other Embodiments

Figure 3A:
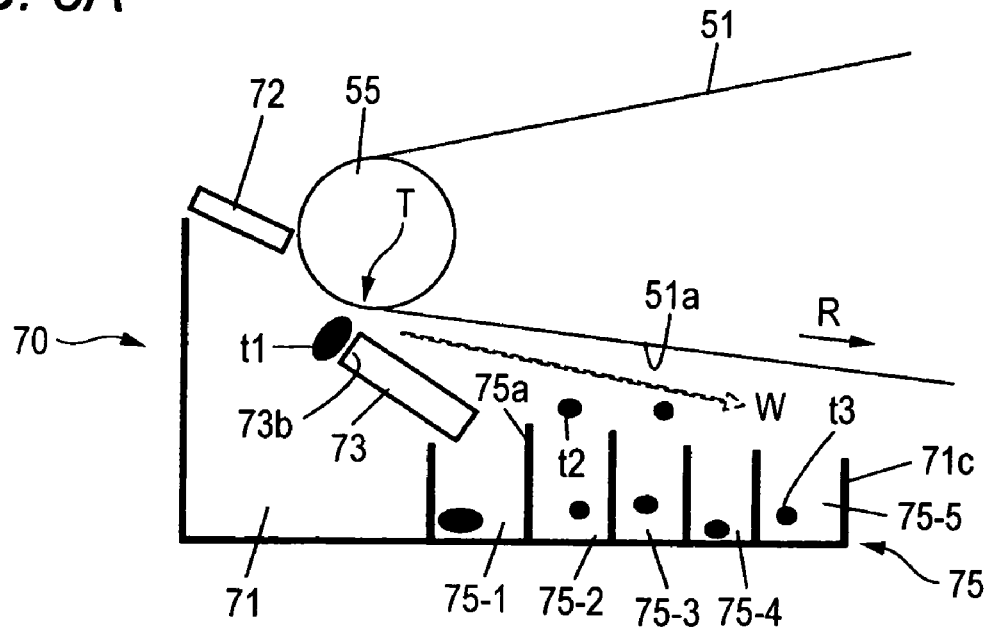
FIGS. 3A and 3B are schematic views each showing another embodiment.
Figure 3B:
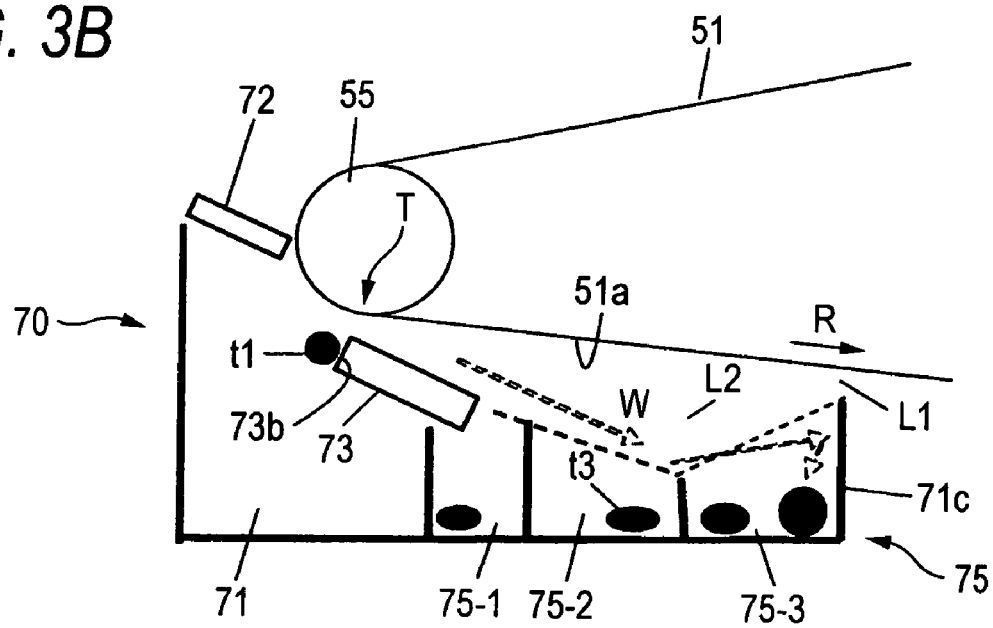

FIGS. 3A and 3B are schematic views each showing another embodiment.

The embodiment shown in FIG. 3A consists in a construction in which a toner reception portion 75 is partitioned by four partition plates 75*a*, thereby to define five toner-capture chambers (75-1 through 75-5).

Even with such a construction, the above functional effects (a), (b) and (e) are attained. Incidentally, toners captured by the toner reception portion 75 are indicated by sign t3.

Further, since the toner reception portion 75 is partitioned into the large number of chambers (five chambers), the area of those inwall surfaces 75*b* of the chambers of the toner reception portion 75 on which the toners can adhere becomes still larger, so that the toners can be captured more efficiently.

The embodiment shown in FIG. 3B consists in a construction in which a toner reception portion 75 is partitioned by two partition plates 75*a*, thereby to define three toner-capture chambers (75-1 through 75-3).

Even with such a construction, the above functional effects (a)–(e) are attained.

That is, the number of the partition plates 75*a* for partitioning the toner reception portion 75 can be appropriately set.

Figure 4A:
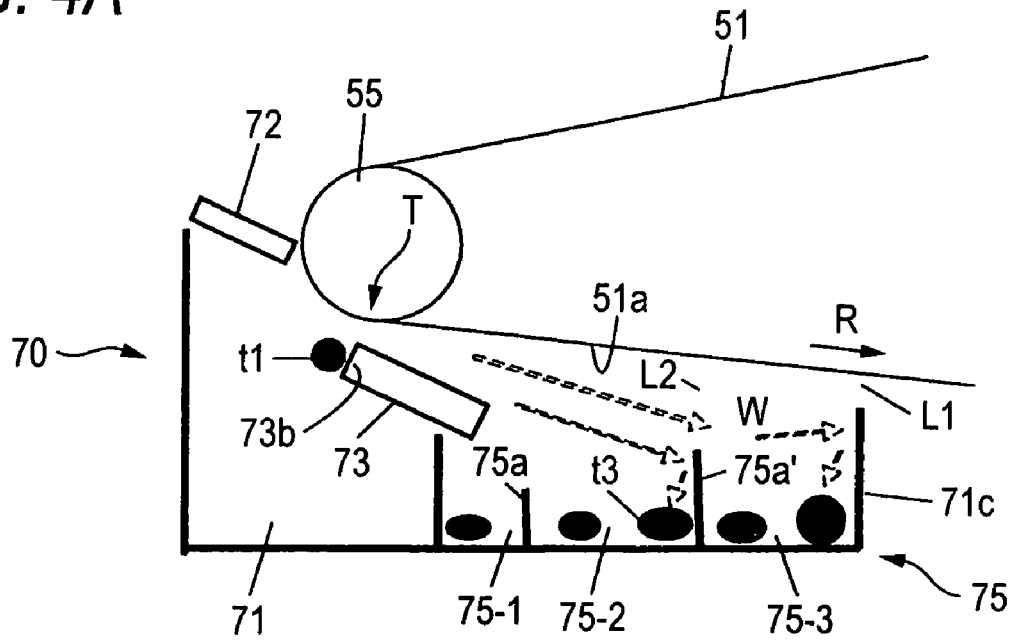
FIGS. 4A and 4B are schematic views each showing another embodiment.
Figure 4B:
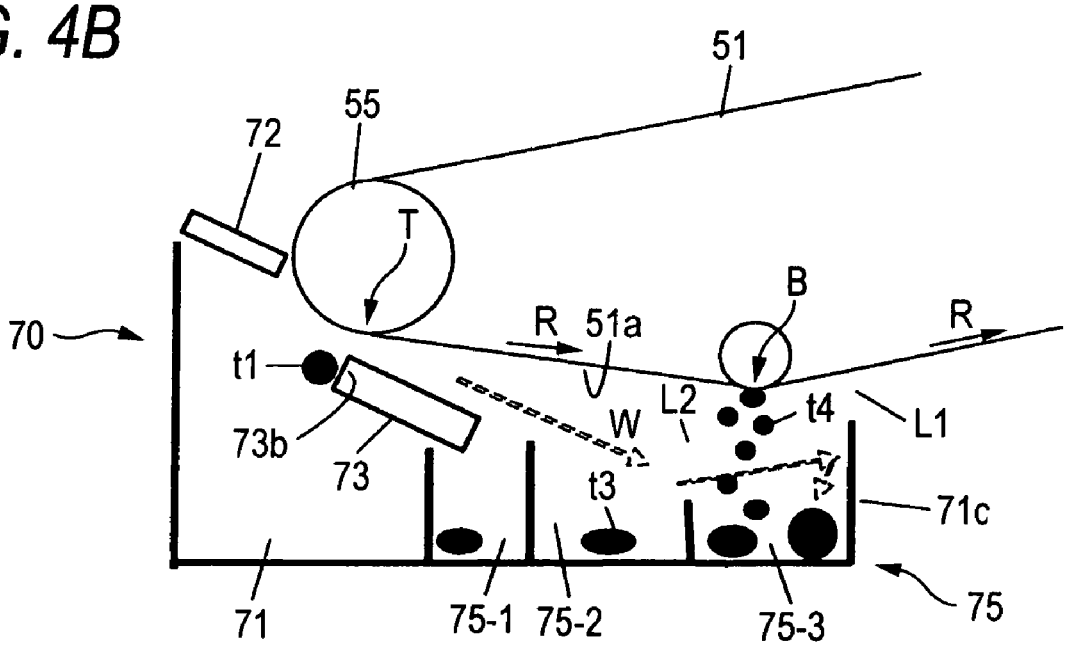

FIGS. 4A and 4B are schematic views each showing another embodiment.

The embodiment shown in FIG. 4A consists in a construction in which a toner reception portion 75 is partitioned by two partition plates 75*a* and 75*a*', and in which the upper ends of the partition plates 75*a* and 75*a*' come nearer to the front surface 51*a* of a toner image carrier on a downstream side in the moving direction of the front surface 51*a* of the toner image carrier.

Even with such a construction, the above functional effects (a)–(e) are attained.

Further, owing to the construction in which the upper ends of the partition plates 75*a* and 75*a*' come nearer to the front surface 51*a* of the toner image carrier on the downstream side in the moving direction of the front surface 51*a* of the toner image carrier, toners can be captured efficiently in stages by three toner-capture chambers (75-1 through 3), and they can be captured substantially equally into the plurality of chambers (75-1 through 3), for the reasons stated before.

The embodiment shown in FIG. 4B consists in a construction in which a bent portion B which changes the traveling direction of a belt 51 is provided on a downstream side than the contact position T between the cleaning device 73 and the toner image carrier 51 as viewed in the moving direction of the front surface 51*a* of the toner image carrier, and in which a toner reception portion 75 is extended to under the bent portion B.

When the bent portion B is provided, the toners which slightly remain on the belt surface 51*a* (in spite of the provision of the cleaning device 73, some toners remain without being removed) might drop from the bent portion B due to slight vibrations in this bent portion B (dropping toners are indicated by sign t4), but such toners t4 can also be captured by extending the toner reception portion 75 to under the bent portion B.

Incidentally, even with such a construction, the above functional effects (a)–(e) are attained.

Although the embodiments of the present invention have been described above, the invention is not restricted to the foregoing embodiments, but it can be appropriately modified and performed within the scope of the purport of the invention.

What is claimed is:

1. An image formation apparatus comprising:

a toner image carrier which rotates with toner images adhering on a surface thereof; and a cleaning device capable of coming into and out of contact with the surface of the toner image carrier, so that toners adherent on the surface of the toner image carrier are removed at a contact position when the cleaning device is in contact with the surface of the toner image carrier;

a toner reception portion disposed on a downstream side of the contact position between said cleaning device and said toner image carrier in a moving direction of the surface of said toner image carrier, and said toner reception portion being partitioned into a plurality of chambers.

2. An image formation apparatus according to claim 1, wherein said toner reception portion is partitioned by a partition plate which extends in a direction substantially orthogonal to the moving direction of the front surface of said toner image carrier with respect to the moving direction.

3. An image formation apparatus according to claim 2, wherein a distance between the surface of said toner image carrier and a first upper end of said partition plate located in said toner reception portion is larger as than a distance between the surface of said toner image carrier and a second upper end of said rising wall located on the most downstream side in the moving direction of the surface of said toner image carrier.

4. An image formation apparatus according to claim 1, wherein an upper end of a rising wall which is disposed on the most downstream side with respect to the moving direction of the surface of said toner image carrier, in said toner reception portion, is adjacent to the surface of said toner image carrier.

5. An image formation apparatus according to claim 3, wherein at least two of the partition plates are arranged in the moving direction of the surface of said toner image carrier, and upper ends of said partition plates becomes nearer to the surface of said toner image carrier toward the downstream side in the moving direction of the surface of said toner image carrier.

6. An image formation apparatus according to claim 1, wherein said toner image carrier is provided with a belt, and a bent portion which changes a traveling direction of said belt is provided on the downstream side in the moving direction of the surface of said toner image carrier, than the contact position between said cleaning device and said toner image carrier, said toner reception portion extending to under said bent portion.

7. An image formation apparatus according to claim 1, wherein said toner reception portion is integrally provided with a cleaning case on which said cleaning device is mounted.

* * * * *